US010723162B2

(12) United States Patent
Sommerer et al.

(10) Patent No.: US 10,723,162 B2
(45) Date of Patent: Jul. 28, 2020

(54) ADHESIVE BINDER

(71) Applicant: MUELLER MARTINI HOLDING AG, Hergiswil (CH)

(72) Inventors: Frank Sommerer, Leipzig (DE); Thomas Friese, Leipzig (DE)

(73) Assignee: MUELLER MARTINI HOLDING AG, Hergiswil (DE)

( * ) Notice: Subject to any disclaimer, the term of this patent is extended or adjusted under 35 U.S.C. 154(b) by 0 days.

(21) Appl. No.: 15/986,573

(22) Filed: May 22, 2018

(65) Prior Publication Data

US 2018/0339538 A1 Nov. 29, 2018

(30) Foreign Application Priority Data

May 24, 2017 (CH) ..... 00680/17

(51) Int. Cl.

| | |
|---|---|
| ***B42C 19/08*** | (2006.01) |
| ***B42C 11/04*** | (2006.01) |
| ***B42C 11/02*** | (2006.01) |
| ***B42C 9/00*** | (2006.01) |

(52) U.S. Cl.

CPC ..... *B42C 19/08* (2013.01); *B42C 9/0006* (2013.01); *B42C 11/02* (2013.01); *B42C 11/04* (2013.01)

(58) Field of Classification Search

CPC ..... B42C 19/08; B42C 9/0006; B42C 11/02; B42C 11/04

USPC ..... 412/1, 4, 5, 6, 8, 9, 33, 37

See application file for complete search history.

(56) References Cited

U.S. PATENT DOCUMENTS

| | | | | |
|---|---|---|---|---|
| 5,114,292 | A | 5/1992 | Geiser | |
| 5,788,446 | A * | 8/1998 | Stolz | B42C 19/08 412/1 |
| 2010/0086379 | A1* | 4/2010 | Langenegger | B42C 9/0037 412/1 |
| 2010/0215459 | A1* | 8/2010 | Garlichs | B42C 19/08 412/9 |

FOREIGN PATENT DOCUMENTS

| | | |
|---|---|---|
| EP | 0453743 B1 | 5/1995 |
| EP | 2738011 A2 | 6/2014 |

OTHER PUBLICATIONS

Dieter Liebau, et al., "Industrielle Buchbinderei", Verlag Beruf + Schule, 2001, p. 307.

International Search Report for CH 6802017, dated Aug. 22, 2017.

* cited by examiner

*Primary Examiner* — Justin V Lewis

(74) *Attorney, Agent, or Firm* — FisherBroyles, LLP; Robert Kinberg

(57) ABSTRACT

The invention relates to an adhesive binder with a machine frame, a plurality of processing stations that are attached to the machine frame, at least two transport clamps for transporting book blocks, at least one closed guide track for the transport clamps, and at least one device for changing the overhang of the book blocks. To realize a technology-required change in the overhang in an easy and secure manner, the at least one device for changing the overhang of the book blocks is arranged in such a way as to operate jointly with a lower edge of at least one of the transport clamps, so that the lower edge can be positioned in several first planes of the adhesive binder, which extend parallel to the at least one closed guide track.

12 Claims, 4 Drawing Sheets

ADHESIVE BINDER

CROSS-REFERENCE TO RELATED APPLICATION

Priority is claimed to Swiss Application No. 00680/17, filed May 24, 2017, the disclosure of which is incorporated herein by reference in its entirety.

BACKGROUND OF THE INVENTION

The invention relates to an adhesive binder with a machine frame and a plurality of processing stations attached to the machine frame, with at least two transport clamps for transporting book blocks, at least one closed guide track for the clamps, and at least one device for changing the overhang of the book blocks.

Adhesive binders are used for the production of adhesive-bound or perfect-bound books (softcover) or book blocks for books with hard covers (hardcover), wherein signatures and/or individual sheets, gathered to form a book block, are joined by applying a general adhesive or glue onto the previously processed book block back and are subsequently provided with a cover (softcover) or with a lining strip (hardcover). The overhang is the part of the book block projecting from a transport clamp of the adhesive binder in the direction of the respective processing stations and on which the various processing steps are carried out in the adhesive binder. The amount of the overhang may have to be changed in dependence on these processing steps, for example when attaching an envelope or a lining strip to the book block. The possible binding methods and the product variants generally depend on the machine components of the adhesive binder. The latter essentially consists of the following functional units: block transporting system, block insertion station, back processing station (back milling), back adhesive application station, intermediate drying station, side adhesive application station, back-reinforcement station, stations for fitting on of an envelope and/or lining strip, pressing on an envelope and/or lining strip, delivery station, and drying station.

According to the prior art, roller chains with movably interlocking individual links are preferably used as conveying means in adhesive binders. The chains function to move the transport clamps forward. The transport clamps are guided by a guide track that is connected to the machine frame of the adhesive binder. Each transport clamp is provided for this with several rolls which roll off the guide surface of the guide track.

In addition to adhesive binders provided with a collating machine and thus automatic feeding, small adhesive binders with start-stop operation are also known, which are frequently equipped with a manual feed station. For this, the book blocks are inserted individually and manually by the machine operator into a stopped transport clamp. The transport clamp then moves the book block past various processing stations through the adhesive binder.

An adhesive binder with automatic feed-in is described, for example, in the EP 2738011 A2. This adhesive binder comprises several processing stations, for example a block inserting station, a back-processing station (back milling device), an adhesive application station, an adhesive application control unit, an envelope feeder and/or a lining station, an envelope and/or liner pressing station, a delivery station and a drying station. This adhesive binder is furthermore provided with at least two book block transport clamps, as well as at least one closed guide track on which the transport clamps circulate and pass the processing stations.

The option of producing individual copies of books or small numbers thereof is increasingly desired not only in the softcover range, but also for producing lined book blocks in the hardcover range. Producing these book blocks for hardcover books requires an adhesive binder provided with a lining station. When attaching the lining strips, it should be possible to adjust in dependence on the end product the excess lining material over a specific region of the book block back. On the one hand, a lining strip with the correct dimensions must be made available by the lining station while, on the other hand, the overhang of the book blocks for binding must exceed the desired excess length of the lining material.

According to page 307 of the technical manual "INDUSTRIELLE BUCH BINDEREI" [Industrial Bookbinding] by Liebau/Heinze, 2001 (ISBN 3-88013, 596-7), the overhang can be selected within specific ranges. In other words, a device for adapting the overhang to the technical requirements of small adhesive binders is basically known. Since the transport clamps of presently known adhesive binders are arranged so as to be fixedly attached to the frame, meaning they are connected immovably to the machine frame or a support structure during the adhesive binding operation, the position of a processing station embodied as resting/vibrating table must first be adjusted, relative to the transport clamps, for a change in the overhang. All other processing stations, such as the back milling, adhesive application, envelope-attachment or lining stations, the pressing and delivery stations, must also be adapted to this change, either manually or automated with the aid of a motor in the case of modern systems.

However, to realize the change in the book block overhang and to maintain the required position accuracy of approximately 0.1 mm requires a considerable expenditure in mechanical equipment, such as linear guides for actuators, adjusting axes with servomotors, as well as sensing equipment in the processing stations. Added to this are relatively complicated sequences in the software.

If we were to follow along the path of solutions known so far, this could result in particular in the development of a height-adjustable back milling device with massive and expensive linear guides. The types of adhesive units, such as the hotmelt roller adhesive application unit, the PUR (polyurethane) adhesive application unit, and the side adhesive application unit would have to be embodied height-adjustable, which could result in complicated structural solutions, especially for an option with "mobile, replaceable adhesive units."

A further problem, specifically in the range of small adhesive binders, are the costs associated therewith, regardless of the existence of a lining station and thus the option of producing book blocks for hardcover books.

SUMMARY OF THE INVENTION

It is an object of the present invention to overcome the disadvantages of the prior art and to provide an adhesive binder which permits a technically easy and thus cost-effective and secure realization of a technologically required change in the overhang. This technical solution should furthermore be suitable for use in small adhesive binders, in an economically supportable manner. Finally, the solution should be suitable for producing softcover books as well as book blocks for hardcover books.

The above and other objects are accomplished by the provision of an adhesive binder, which in one embodiment includes a machine frame; a plurality of processing stations attached to the machine frame; at least one closed guide track; at least two transport clamps for transporting respective book blocks and being coupled to the at least one closed guide track; and at least one device arranged to change an overhang of one of the book blocks of one of the transport clamps, so that the device cooperates with a lower edge of the one transport clamp, wherein the lower edge is positionable in a plurality of first planes which extend parallel to the at least one closed guide track.

Thus, according to the invention, at least one device for changing the book block overhang is arranged so as to cooperate with the lower edge of at least one of the transport clamps, such that this lower edge can be positioned in several first planes of the adhesive binder which are arranged parallel to the at least one closed guide track of the transport clamps. Owing to this embodiment of the adhesive binder, the change in the overhang can be realized technically easy and thus cost-effective, secure and without having to adjust the processing stations. An easier machine guidance through the operating personnel is furthermore possible since only one parameter of the adhesive binder must be changed, as compared to the prior art.

One embodiment of the adhesive binder according to the invention provides that the at least one closed guide track of the adhesive binder can be positioned in several second planes which extend parallel to each other, wherein this makes possible a particularly easy and secure change in the guide track position and thus the overhang. In general, the first and the second planes extend horizontal, meaning parallel to the setup surface and/or to the machine frame of the adhesive binder. Of course, these planes can also extend optionally inclined.

According to a further embodiment of the inventive adhesive binder, the at least one device for changing the overhang of the book blocks is arranged between the at least one closed guide track for the transport clamps and the machine frame of the adhesive binder, thereby making it possible to realize an especially simple and space-saving solution.

Yet another embodiment of the adhesive binder according to the invention provides that the at least one closed guide track for the transport clamps is connected to a base plate. With this embodiment, the at least one device for changing the overhang of the book blocks is arranged between the base plate and the machine frame for the adhesive binder. On the one hand, the use of such a base plate results in a simple and cost-effective support of the at least one closed guide track. On the other hand, the at least one device for changing the overhang of the book blocks can be attached advantageously to the base plate or can be accommodated therein.

According to a different embodiment of the adhesive binder according to the invention, a resting/vibrating table for the overhang of the book block is attached to the machine frame of the adhesive binder. A resting/vibrating table of this type offers a simple and cost-effective solution for the temporary placement of the book block overhang during the adjustment operation. When using a resting/vibrating table, the still loose book block placed thereon is vibrated during a first phase, wherein the individual signatures and/or sheets can initially align themselves. The vibration is stopped during a second phase, so that the still unbound book block can come to rest before it is taken over by the respective transport clamp, and so that the signatures and/or sheets can assume a defined position while resting on the resting/vibrating table. The overhang of the book block can then be adjusted starting from this defined position.

According to another embodiment of the adhesive binder according to the invention, the lower edge of at least one of the transport clamps is arranged parallel and vertically adjustable, relative to the processing stations. On the one hand, such an adjustment can be realized relatively easily while, on the other hand, the book blocks to be processed always remain advantageously oriented in the same way, relative to the working position of the processing tools. The at least one closed guide track is also arranged in the same way.

According to a different embodiment of the inventive adhesive binder, a joint device is provided for all transport clamps for changing the overhang of the book blocks. As a result, the adhesive binder can be adapted quickly and easily to expected future production orders. Of course, the separate transport clamps can also be provided with separate devices for changing the overhang of the book blocks, which are connected to a machine control of the adhesive binder. With such a solution, the devices for changing the overhang of the book blocks can be activated either jointly or separately by the machine control.

For a different embodiment of the inventive adhesive binder, the device for changing the book block overhang is embodied for a continuous change, or a change relative to the final position, thus permitting an especially precise or an especially quick activation of this device.

According to yet another embodiment of the inventive adhesive binder, the device for changing the book block overhang is designed to be driven either hydraulically, via electric motor, pneumatically and/or mechanically, wherein this relates to a selection of especially advantageous solutions for the operation of such a device.

Another adhesive binder according to the invention is embodied as a small adhesive binder. This is designed to illustrate that the solution is suitable for use not only with industrial-type adhesive binders, but also with small adhesive binders to which the book blocks for binding are mostly supplied manually.

According to another embodiment of the inventive adhesive binder, at least one of its processing stations is designed as lining station.

In addition to the production of softcover books, the adhesive binder can accordingly also be used for producing hardcover books.

The invention further relates to a method of producing softcover books or book blocks for hardcover books which utilizes the adhesive binder as described above.

BRIEF DESCRIPTION OF THE DRAWINGS

In the following, the invention is described in more detail with the aid of exemplary embodiments, which show in.

DETAILED DESCRIPTION OF THE INVENTION

Figure 1:
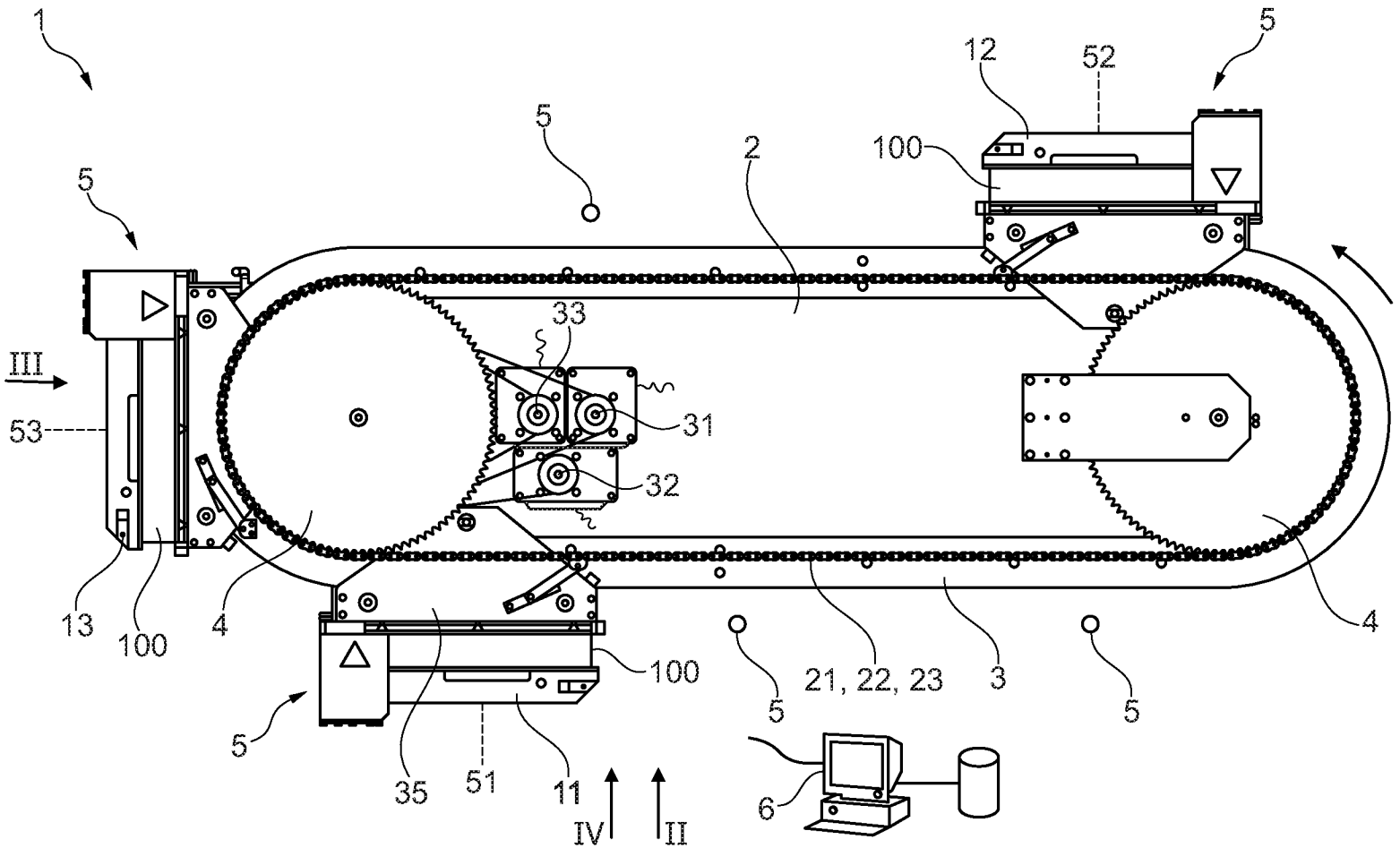
FIG. 1 a view from above of an inventive adhesive binder.

FIG. 1 shows a view from the top of an adhesive binder 1 according to the invention which is suitable for producing softcover books or hardcover books. This adhesive binder 1 comprises a book block transporting system 2 with a closed guide track 3 and thereto attached three transport clamps 11, 12, 13, which can be moved with the aid of a guide arrangement 35 past processing stations 5 that are attached immovably to a machine frame 7 (FIGS. 3, 4) of the adhesive binder 1. A block inserting station, a back-processing station (back milling unit), an adhesive application station, an adhesive application control, an envelope feeder and/or a lining station, a delivery station and a drying station as examples for these processing stations 5.

The adhesive binder 1 furthermore has three drives 41, 42, 43 (FIG. 2), wherein a first drive 41 is assigned to a first transport clamp 11, a second drive 42 is assigned to a second transport clamp 12, and a third drive 43 is assigned to a third transport clamp 13. The drives respectively have one drive chain 21, 22, 23 to which the assigned transport clamp 11, 12, 13 is attached and which is operated via a drive motor 31, 32, 33, with the aid of a separate chain wheel 4 (FIG. 1). The drive motors 31, 32, 33 are activated by a machine control 6 of the adhesive binder 1. Speed profiles are stored in the machine control 6, so that the transport clamps 11, 12, 13 can each be moved with a separate speed profile along the guide track 3. Of course, a book block transporting system 2 can also be used which is provided with only two or with more than three transport clamps 11, 12, 13 and the corresponding number of operating devices.

The adhesive binder 1 comprises a number of stop positions 51, 52, 53 where a transport clamp 11, 12, 13 can be stopped, respectively by the associated drive 41, 42, 43. For example, a first stop position 51 is intended for inserting loose book blocks, a second stop position 52 is for pressing a non-depicted envelope against a book block 100, and a third stop position 53 is intended for discharging bound book blocks 100. If a processing station 5 is provided, which is embodied as lining station for attaching a lining strip, another stop position is provided at that location. Differently long stop intervals can be stored in the machine control 6 for the stop positions 51, 52, 53.

Figure 2:
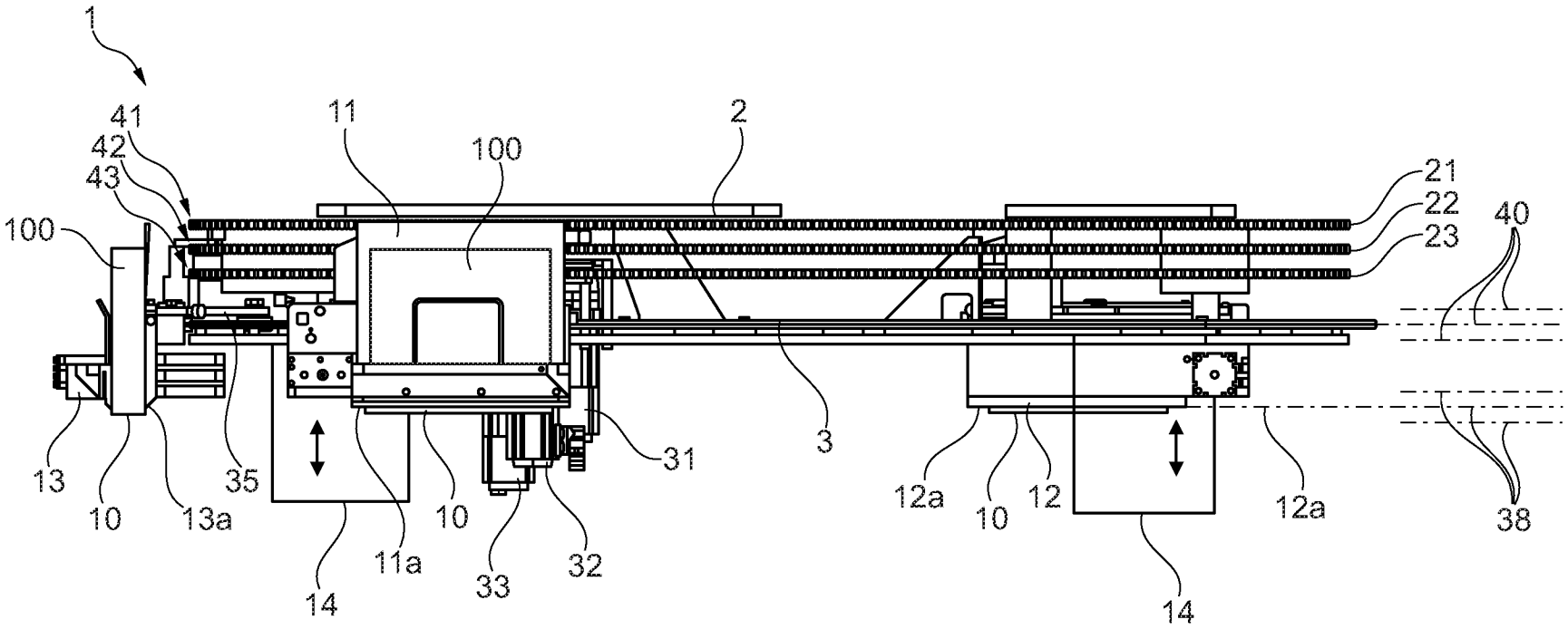
FIG. 2 a view from the side of the adhesive binder according to FIG. 1.

A view from the side of the same adhesive binder 1 is shown in FIG. 2, from the direction of the arrow II in FIG. 1, which clearly shows the arrangement of the drive chains 21, 22, 23 that form a part of the respective drive 41, 42, 43. The book blocks 100 clamped into and thus conveyed with the transport clamps 11, 12, 13 respectively have a back portion, called overhang 10, that projects from the transport clamps 11, 12, 13 in the direction of the processing station 5. The various processing steps are realized in the adhesive binder 1 on this overhang 10, which projects over at least one of the lower edges 11*a*, 12*a*, 13*a* of the transport clamps 11, 12, 13. FIG. 2 schematically shows a device 14, arranged on the adhesive binder 1, which is designed for changing the overhang 10 of the book block 100 and thus the distance relative to the stationary processing stations 5. The device 14 is shown in further detail in FIGS. 3 and/or 4.

Figure 3:
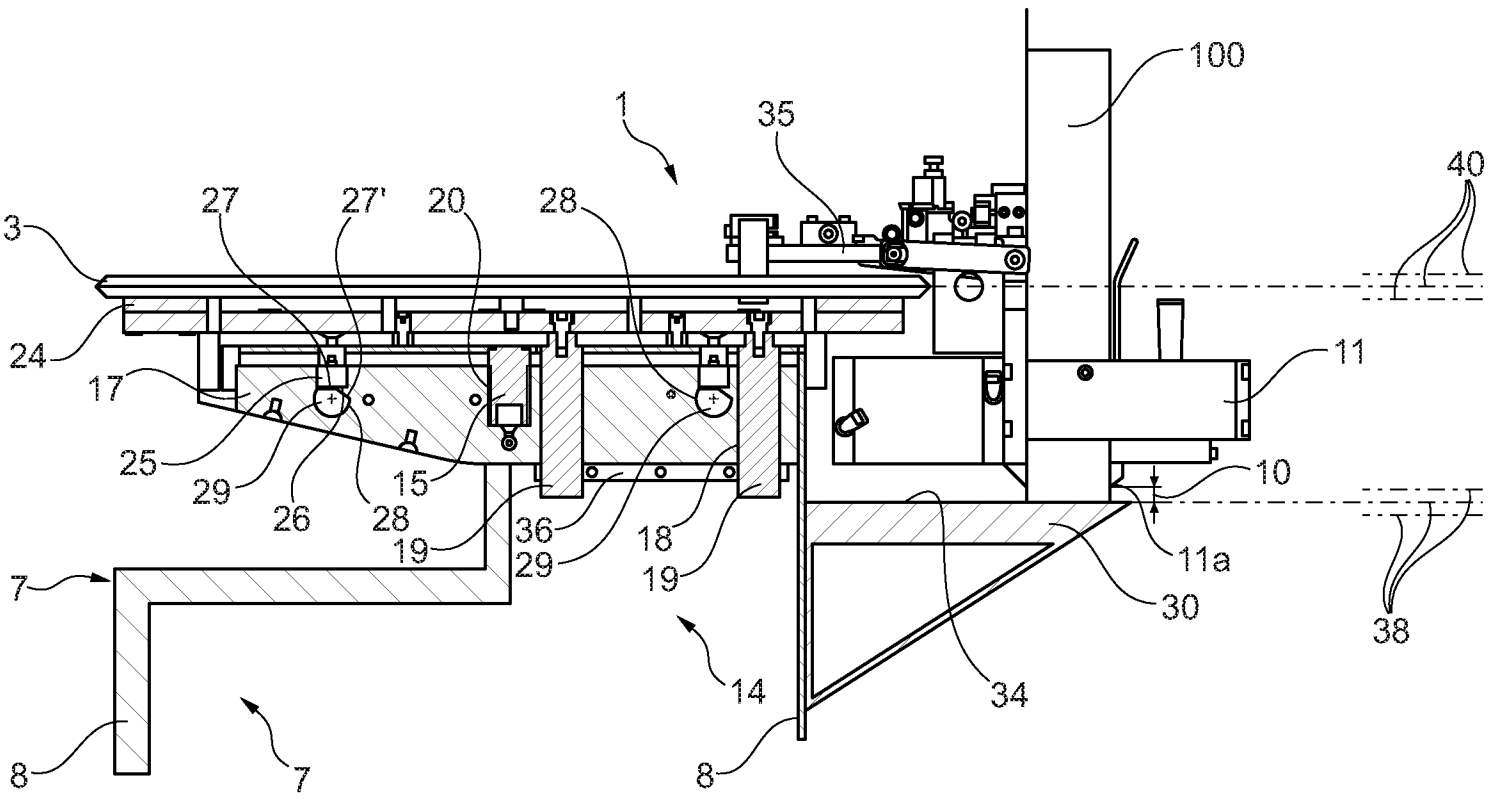
FIG. 3 a schematic sectional view of an adhesive binder according to the invention.

FIG. 3 illustrates a sectional view of an adhesive binder 1 according to the invention, as seen from the direction of arrow III in FIG. 1, wherein a machine frame 7 of the adhesive binder 1 is also shown. Between two successively arranged supports 8 of the machine frame 7, one of several support elements 17 is shown which is fixedly attached to the adhesive binder 1 and serves to hold the device 14 for adjusting the overhang 10. The support elements 17 are respectively provided with two vertically arranged recesses 18, wherein a sliding guide element 19 is positioned in each of these recesses 18. The individual support elements 17 are furthermore provided with another vertical recess 20 with therein arranged hydraulic cylinder 15 of a hydraulic lifting unit, which is not shown further herein. The hydraulic cylinders 15, for example embodied as screw-in cylinders, can be moved continuously upward, thus vertically lifting a base plate 24 that supports the closed guide track 3. The base plate 24 is fixedly connected to a respective upper end of the two guide elements 19, e.g. with screws. Two cylinder-shaped support elements 25 are attached to the base plate 24, which respectively rest with a bottom surface 26 on corresponding first surfaces 27 of a cylindrical eccentric cam 29 which is respectively arranged in a horizontal recess 28 of the support element 17. The device 14 for adjusting the overhang 10 thus comprises the sliding guide elements 19, the hydraulic cylinders 15 of the hydraulic lifting unit, the cylinder-shaped support elements 25, and the cylinder-shaped eccentric cams 29. Of course, the guide track 3 can also be embodied without such a base plate 24 or without a similar intermediate element. In that case, the device 14 directly engages in the guide track 3 for changing the overhang 10 of the book blocks 100.

A resting/vibrating table 30 (FIG. 3) is arranged at one of the supports 8 of the machine frame 7, in the region of the processing station 5 (FIG. 1) that is embodied as block inserting station. This resting/vibrating table 30 comprises a flat, horizontally arranged surface 34 for temporarily accommodating the back region of the book block 100 and thus for adjusting the overhang 10. A single transport clamp 11 only is shown in FIG. 3. This transport clamp 11 holds the book block 100 in the standard manner, wherein the overhang 10 projects downward in the direction of a processing station 5 from the transport clamp 11, so as to extend past the lower edge 11*a* that is not shown herein and comes to rest on the surface 34 of the resting/vibrating table 30.

To adjust the overhang 10, the base plate 24 with the closed guide track 3 and the support elements 25 is first lifted up with the aid of the hydraulic lifting unit of the device 14, meaning with the hydraulic cylinders 15. The hydraulic cylinders 15 have a maximum lift of approximately 16 mm, for example, and are activated by the machine control 6 (FIG. 1) and a non-depicted, controllable hydraulic pump in the manner known per se, and are initially extended to the maximum lift. At the same time, the lower base surfaces 26 of the support elements 25 are also lifted off the respective corresponding first surfaces 27 on the eccentric cam 29. The eccentric cams 29 are then adjusted manually or automatically to a desired position. The base plate 24 and thus also the guide track 3 are again lowered with the hydraulic cylinders 15 until the lower base surfaces 26 of the support elements 25 come to rest on a corresponding second surface 27' of the eccentric cam 29, but this time on a different surface selected to correspond to the required adjustment of the overhang 10. By correspondingly turning the eccentric cams 29, at least three height levels can be selected and adjusted, namely a first height level that corresponds to the starting position, a second height level which, for example, results in an overhang 10 of the book block 100 of 11 mm, and a third height level that results in an overhang 10 of 15 mm. For this final-position related adjustment of the overhang 10, the guide elements 19 ensure an optimally guided movement of the base plate 24, so that the desired orientation of the closed guide track 3 is reliably maintained.

With the aid of the respective guide arrangement 35, the positions in height of the transport clamps 11, 12, 13 and/or the respective lower edges 11*a*, 12*a*, 13*a* thereof is adjusted, relative to the immovable resting/vibrating table 30. In this way, the lower edges 11*a*, 12*a*, 13*a* of the transport clamps 11, 12, 13 can be positioned in several first planes 38 of the adhesive binder 1 which extend parallel to the closed guide track 3. In the same way, the closed track 3 of the adhesive binder 1 can be positioned in several parallel extending second planes 40. A book block 100 which is subsequently held in the respective transport clamp 11, 12, 13 is positioned with its back region on the surface 34 of the resting/vibrating table 30 and, following the closing of the respective transport clamp 11, 12, 13, has an overhang 10 that meets requirement. The selected adjustment of the overhang 10 is realized with a clamping unit 36 that is effective between the support element 17 and the guide elements 19.

Figure 4:
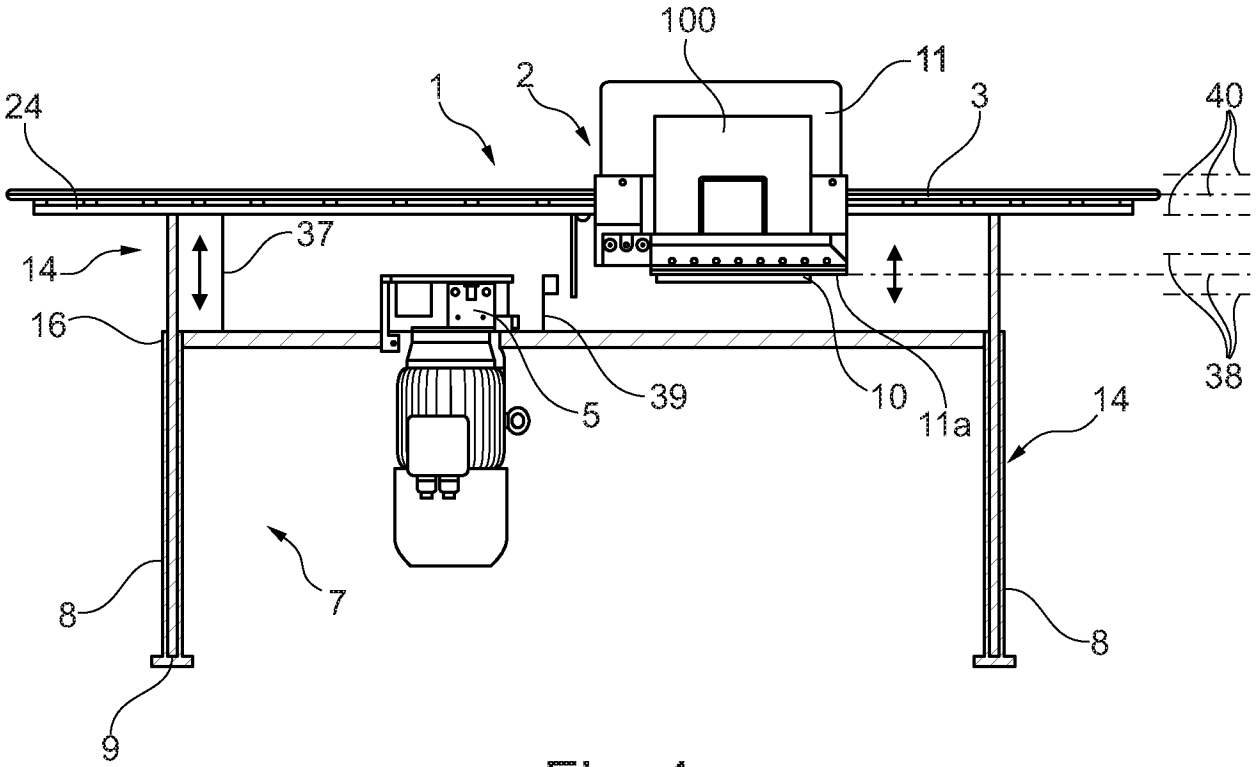
FIG. 4 a schematic and simplified view from the side of an alternative adhesive binder according to the invention, provided with a processing device.

FIG. 4 schematically shows a view from the side of an alternative embodiment of the adhesive binder 1, as seen from the direction of arrow IV in FIG. 1, wherein the machine frame 7 of the adhesive binder 1 is also shown and a single processing station 5 in the form of a back-milling unit is explicitly illustrated. In FIG. 4, the transport clamps 11, 12, 13 are represented only by the first transport clamp 11. The book block 100 clamped in and conveyed with the transport clamp 11 has an overhang 10 that projects out of the transport clamp 11 in the direction of the processing station 5, embodied as a back-milling device. The overhang 10 that projects over the lower edge 11*a* of the transport clamp 11 is mechanically processed with the back-milling device and is roughed up in the process, so that this back region of the book block, which so far is still loose, can be provided with sufficient adhesive in a processing station 5, arranged father downstream and embodied as adhesive-application station, in order to combine the signatures and/or individual sheets into a bound book block 100. An envelope or a lining strip (not shown) is subsequently attached thereto. Finally, the machine frame 7 is provided with several hollow supports 8 with feet 9.

The device 14 for changing the overhang 10 of the book block 100 in this case is also arranged between the machine frame 7 and the base plate 24 that supports the closed guide track 3 and essentially comprises at least one continuously adjustable control element 37, but preferably several control elements 37, as well as a number of linear guides 16 which can be arranged vertically adjustable inside the hollow supports 8 of the machine frame 7 and are respectively attached to the base plate 24 that supports the guide track 3. Following an adjustment of the overhang 10, the lower edges 11*a*, 12*a*, 13*a* of the transport clamps 11, 12, 13 are respectively located in a different first plane 38, and the guide track 3 is respectively located in a corresponding second plane 40, meaning they are displaced parallel and perpendicular to the fixed plane of the processing stations 5. This exemplary embodiment also comprises a resting/vibrating table 30 for changing the overhang 10, which is not shown herein and is attached to the machine frame. The overhang 10 for the above-described embodiment varies progressively in the range of 11 to 15 mm. The device 14 for this embodiment only needs to make a central adjustment of the lower edges 11*a*, 12*a*, 13*a* of the transport clamps 11, 12, 13, along with a vertical adjustment of the guide track 3. All processing stations 5 remain unchanged in their optimum position.

The adjustment of the closed guide track 3 for this embodiment also occurs via a hydraulic lifting unit which is not shown. The linear guides 16 ensure a precise, vertical adjustment of the lower edges 11*a*, 12*a*, 13*a* of the transport clamps 11, 12, 13 and the guide track 3, with the required precision of at least 0.1 mm. A standard displacement sensor 39, for example arranged between the base plate and the machine frame, provides the machine control 6 (FIG. 1) and the machine operator with feedback on the respective current value for the realized overhang 10.

Alternatively, it is also possible to arrange on each transport clamp 11, 12, 13 a device 14 for changing the overhang 10 of the book block 100, which device is connected to a machine control 6 of the adhesive binder. With a non-depicted solution of this type, which is not shown herein, the devices 14 can be activated jointly or separately by the machine control 6.

Of course, systems other than the previously described adhesive binder 1 can also be provided with such a device 14 for changing the overhang 10 the book block 100.

It will be understood that the above description of the present invention is susceptible to various modifications, changes and adaptations, and that the same are intended to be comprehended within the meaning and range of equivalents of the appended claims.

What is claimed is:

1. An adhesive binder, comprising:
a machine frame;
a plurality of processing stations attached to the machine frame;
a closed guide track;
at least two transport clamps for transporting respective book blocks and being coupled to the closed guide track; and
at least one device arranged to vertically change an overhang of the book blocks of one of the transport clamps, so that the device cooperates with a lower edge of the one transport clamp, wherein the lower edge is positionable in a selected one of a first plurality of horizontal planes which extend parallel to the closed guide track.

2. The adhesive binder according to claim 1, wherein the closed guide track of the adhesive binder is vertically positionable in a selected one of a second plurality of parallel extending, horizontal planes.

3. The adhesive binder according to claim 1, wherein the at least one device to change the overhang of the book blocks is arranged between the closed guide track of the transport clamps and the machine frame for the adhesive binder.

4. The adhesive binder according to claim 1, further including a base plate, wherein the closed guide track is connected to the base plate, and the at least one device for changing the overhang of the book blocks is arranged between the base plate and the machine frame of the adhesive binder.

5. The adhesive binder according to claim 1, further including a resting/vibrating table for the overhang of the book blocks attached to the machine frame.

6. The adhesive binder according to claim 1, wherein the lower edge of the one transport clamp is arranged parallel and vertically adjustable relative to the processing stations.

7. The adhesive binder according to claim 1, wherein the device to change the overhang of the book blocks comprises a joint device for changing the overhang of book blocks for all transport clamps.

8. The adhesive binder according to claim 1, wherein the device for changing the overhang of the book blocks is continuously adjustable or adjustable relative to an end position.

9. The adhesive binder according to claim 1, wherein the device for changing the overhang of the book blocks is driven one of hydraulically, by an electric motor, pneumatically and mechanically.

10. The adhesive binder according to claim 1, wherein at least one of the processing stations comprises a lining station.

11. A method of producing softcover books or book blocks for hardcover books, comprising utilizing the adhesive binder according to claim 1.

12. An adhesive binder, comprising:

a machine frame;

a plurality of processing stations attached to the machine frame;

a closed guide track;

at least two transport clamps for transporting respective book blocks and being coupled to the closed guide track;

at least one device arranged to change an overhang of the book blocks of one of the transport clamps, so that the device cooperates with a lower edge of the one transport clamp, wherein the lower edge is positionable in a selected one of a first plurality of planes which extend parallel to the closed guide track;

at least first and second chain drives attached to the at least two transport clamps, respectively; and at least first and second drive motors to drive the at least first and second chain drives, respectively, so that the transport clamps move along the closed guide track according to respective speeds provided by a machine control.

* * * * *